US006244378B1

(12) United States Patent
McGrath

(10) Patent No.: US 6,244,378 B1
(45) **Date of Patent: *Jun. 12, 2001**

(54) DUAL SONIC CHARACTER ACOUSTIC PANEL AND SYSTEMS FOR USE THEREOF

(75) Inventor: Ralph D. McGrath, Granville, OH (US)

(73) Assignee: Owens Corning Fiberglas Technology, Inc., Summit, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/209,577

(22) Filed: Dec. 11, 1998

(51) Int. Cl.[7] ..... E04B 1/82

(52) U.S. Cl. ..... 181/292; 181/290; 181/288; 181/30; 52/145; 428/116; 493/966

(58) Field of Search ..... 181/292, 291, 181/290, 288, 286, 284, 30; 52/144, 145, 815, 823; 428/116, 118; 493/966

(56) References Cited

U.S. PATENT DOCUMENTS

| | | | | |
|---|---|---|---|---|
| 2,840,179 | | 6/1958 | Junger . | |
| 3,180,448 | | 4/1965 | Gary, Jr. et al. . | |
| 3,696,571 | * | 10/1972 | Schluter | 52/144 |
| 4,001,473 | * | 1/1977 | Cook | 428/116 |
| 4,084,367 | | 4/1978 | Saylor et al. . | |
| 4,137,678 | * | 2/1979 | Varlonga | 52/39 |
| 4,522,284 | | 6/1985 | Fearon et al. . | |
| 4,538,390 | * | 9/1985 | Yeager et al. | 52/221 |
| 4,539,244 | * | 9/1985 | Beggs et al. | 428/116 |
| 4,901,485 | * | 2/1990 | Menchetti et al. | 52/145 |
| 5,459,291 | | 10/1995 | Haines et al. . | |
| 5,492,749 | * | 2/1996 | Solves et al. | 428/172 |
| 5,543,198 | * | 8/1996 | Wilson | 428/116 |
| 5,923,002 | * | 7/1999 | McGrath et al. | 181/290 |

FOREIGN PATENT DOCUMENTS

| | | |
|---|---|---|
| 91 11 178 U | 10/1991 | (DE) . |
| 0 201 104 A1 | 11/1986 | (EP) . |
| 0 816 583 A1 | 1/1998 | (EP) . |
| 1 254 648 | 5/1961 | (FR) . |
| 827042 | 2/1960 | (GB) . |
| WO 98/55709 | 12/1998 | (WO) . |

* cited by examiner

*Primary Examiner*—Jeffrey Donels
*Assistant Examiner*—Edgardo San Martin
(74) *Attorney, Agent, or Firm*—Inger H. Eckert; Stephen W. Barns

(57) ABSTRACT

An acoustically significant composite panel having a general sound-absorbing face (or a general sound-diffusing face) and a tuned sound-absorbing face. Such a panel includes a sandwich or composite of a first layer of molding media, a honeycomb of cells and a second layer of molding media. The first layer has at least one or more apertures in it that convert the corresponding cells into Helmholtz resonators. These Helmholtz resonators can be tuned to the same or different frequencies. The second layer is generally sound-absorbing. A general diffuser structure can be attached to the second layer. These panels can be attached to the walls and/or ceilings of a room to control its sonic quality. Also, these panels can be suspended vertically below a ceiling to control noise.

26 Claims, 6 Drawing Sheets

DUAL SONIC CHARACTER ACOUSTIC PANEL AND SYSTEMS FOR USE THEREOF

TECHNICAL FIELD AND INDUSTRIAL APPLICABILITY OF THE INVENTION

The invention is directed towards an acoustical panel for sound control, and more particularly towards an acoustical panel exhibiting dual sonic qualities, and also towards systems for use of such panels.

BACKGROUND OF THE INVENTION

In a variety of circumstances, it is desirable to control the sonic quality of a region or volume. Such a region or volume includes: an auditorium, movie theater or concert hall; an outdoor stage (whether or not located under a pavilion), an amphitheater; an indoor sports arena with audience seating, an at least semi-enclosed stadium or gymnasium; a room being used as a home theater; an office; and a recording studio.

The existing sound-absorbing panel technology, for example, the Saylor patent (U.S. Pat. No. 4,084,367 to Saylor et al., patented Apr. 18, 1978, is not appropriate for the circumstances mentioned above. The Saylor patent is directed toward a room partition, i.e., a sound-absorbing free-standing panel, that is sufficiently strong to permit fixtures and accessories to be hung from it. The panels of the Saylor patent are formed of a rigid metal frame to which front and back sheet metal skins are attached. The cavity defined by the frame and skins is filled with a honeycomb of cells. Holes are selectively punched into the skins to convert the corresponding cells into Helmholtz resonators. Each of the skins is covered by a layer of porous, low density, sound-absorbing material.

The porous, low density, sound-absorbing layers absorb sound in the range of 1000 to 2000 Hertz (Hz). As is well known, a Helmholtz resonator absorbs sound waves of a certain frequency. The Helmholtz resonators of the Saylor patent are tuned to absorb at a frequency of about 500 Hz.

By structurally connecting the core and the frame together, the skins can effectively function as stressed skins. This provides the free-standing panel with substantially increased rigidity, strength and durability. Such a free-standing panel is sufficiently strong to permit fixtures such a desks, bookshelves, file cabinets, etc. to be hung on it.

The Saylor patent acknowledges that there are other ways to construct an acoustic panel, such as a rectangular frame, surrounding around a fiberglass core, covered with fabric. However, the Saylor patent indicates that such a core lacks structural strength, which prevent this type of panel from being sufficiently rigid and strong to permit fixtures such as desks, bookshelves, file cabinets, etc., to be hung from it.

The great rigidity and strength of the panel according to the Saylor patent comes at the expense of great weight. This is not a significant problem for the intended purpose of the Saylor patent, namely a free-standing room partition. However, as recognized above, there are a great many circumstances in which an acoustically significant panel need not be free-standing, nor can it be very heavy.

For example, in a recording studio, it is desirable to control the acoustics of the room by attaching acoustically significant panels to the walls and/or ceiling. This is impractical with very heavy panels. Similarly, in a pavilion, arena or gymnasium, it is impractical to attach a great many very heavy panels to a ceiling that spans a great distance. Unless specifically engineered to handle such a load (at a much greater construction cost), a roof/ceiling of a pavilion, arena or gymnasium cannot support a great many, very heavy panels such as those of the Saylor patent.

The metal skins of the acoustic panel according to the Saylor patent also act as diffusers of sonic energy, which undermine the effectiveness of the overall sound-absorbing ability of the free-standing panel. This is recognized in the Fearon patent (U.S. Pat. No. 4,522,284 to Fearon et al., patented Jun. 11, 1985), which indicates that the skins reflect a large percentage of sound back into the work area. The Fearon patent departs completely from the stressed skin technique of the Saylor patent. Instead, the Fearon patent discloses a composite acoustic panel that is a sandwich of a layer of molding media, a honeycomb of cells and another layer of molding media. Despite the Saylor patent's extensive discussion of Helmholtz resonators formed in the stressed metal skins, the Fearon patent does not contemplate forming Helmholtz resonators in the core of the "molding media sandwich."

SUMMARY OF THE INVENTION

The invention reflects, among other things, a recognition that it is desirable to adapt a general sound-absorbing panel employing composite technology to a tuned absorber panel.

The invention also reflects, among other things, a recognition that general sound-absorbing composite panel technology can be adapted to tuned sound-absorbing panel technology by forming Helmholtz resonators in the honeycomb of cavities that exist in a general sound-absorbing composite technology.

The invention also reflects, among other things, a recognition that a single acoustic composite panel can be adapted to exhibit both a general sound-absorbing character and a tuned sound-absorbing character, i.e. a dual sonic character, via the formation of Helmholtz resonators in composite panel technology.

The invention also reflects, among other things, a recognition that tuned sound-absorbing panels can be used in a great many more circumstances than merely room partitions, if the weight of the panels is greatly reduced.

Then invention also reflects, among other things, a recognition that the weight of tuned sound-absorbing panels can be greatly reduced by forming Helmholtz resonators in the honeycomb of cavities that exist in a light weight, general sound-absorbing composite panel.

The invention provides, among other things, an acoustically significant panel having a general sound-absorbing face and a tuned sound-absorbing face. Such a panel includes a sandwich or composite of a first layer of molding media, a honeycomb of cells and a second layer of molding media, where the first layer has one or more apertures in it. These apertures convert the corresponding cells into Helmholtz resonators. The Helmholtz resonators may be tuned to the same, or different, frequencies.

The invention also provides, among other things, an acoustically significant panel having a general sound-diffusing face and a tuned sound-absorbing face. Such a panel includes: a molding media sandwich, where the first molding media layer has one or more apertures in it that convert the corresponding cells into a Helmholtz resonators; and a general diffuser structure attached to the second molding media layer.

The invention also provides, among other things, a sound control system for a region defined by a ceiling and/or one or more walls. Such a system comprises one or more acoustically significant panels attached to the ceiling and/or one or more walls, where at least one of the panels has a tuned sound-absorbing face, and at least one of the panels has a general sound-absorbing face or a general sound-diffusing face. Typically, each of the panels will have a tuned sound-absorbing face and a general sound-absorbing face.

The invention also provides, among other things, a noise-dampening system for a region underneath, and defined by, a ceiling. The system comprises: one or more sound-absorbing panels; and multiple connectors to suspend the panels from the ceiling. Each of the panels is suspended vertically from the by one or more of the connectors. Preferably, each one of the sound-absorbing panels has a tuned sound-absorbing face and a general sound-absorbing face.

The present invention will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus do not limit the invention and wherein.

DETAILED DESCRIPTION AND PREFERRED EMBODIMENTS OF THE INVENTION

Figure 1:
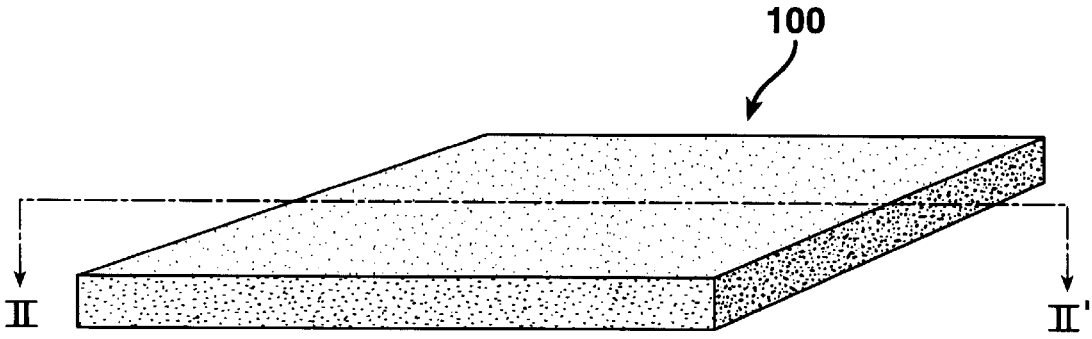
FIG. 1 is a three quarter perspective view of a first embodiment, according to the invention, which emphasizes an acoustically significant panel.
Figure 2:
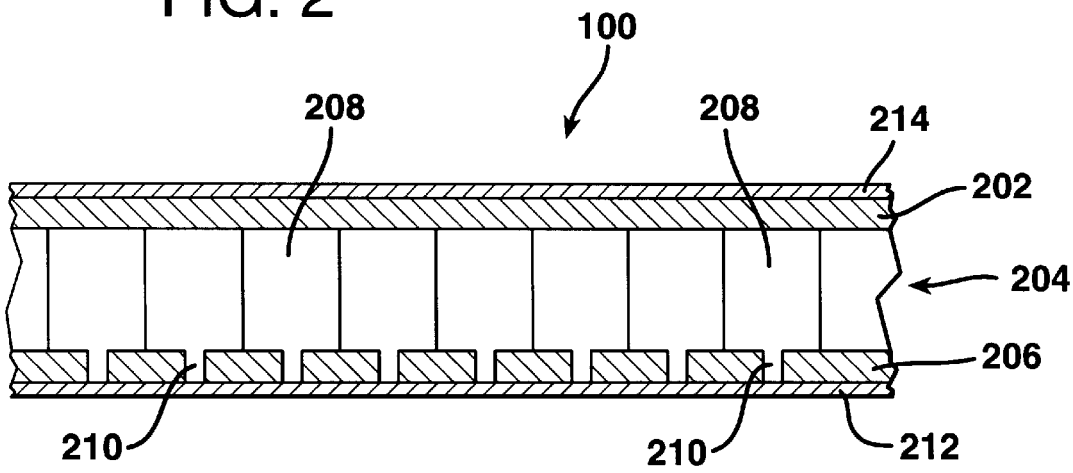
FIG. 2 is a cross-section view of the first embodiment.

FIG. 1 is a three quarter perspective view of a first embodiment, of the invention, which emphasizes an acoustically significant panel 100. FIG. 2 is a cross-section view of the first embodiment. The panel 100 is a sandwich or composite panel that includes: a first layer 202 of molding media; a honeycomb 204 of cells; and a second layer 206 of molding media. Optionally, and preferably, the panel 100 includes a first layer 212 and a second layer 214 of acoustically transparent, decorative fabric or fibrous matting. The panel 100 can be relatively large, e.g., 4 ft×8 ft.

When attached to the first layer 202 and the second layer 206, each cell in the honeycomb 204 of cells defines a cavity or chamber 208. The second layer 206 of molding media has one or more apertures 210 in it, each of which converts the corresponding chamber 208 into a Helmholtz resonator. As will be discussed in more detail below, the Helmholtz resonators can be tuned to the same or different frequencies. Preferably, but not necessarily, the apertures 210 are circular.

The technology to form a sandwich or composite panel (albeit without holes formed in the chambers to define Helmholtz resonators) is known, e.g., the Fearon patent (again, U.S. Pat. No. 4,522,284 to Fearon et al., patented Jun. 11, 1985), which is hereby incorporated by reference in its entirety. The honeycomb is formed, e.g., of cardboard or paper.

Examples of the molding media of the first layer 202 and the second layer 206 are medium density moldable fiberglass (approximate density of 3 lbs/ft$^3$) , open-cell melamine foam (approximate density of 0.7 lbs/ft$^3$)or mineral wool board (approximate density of 3–5 lbs/ft$^3$). From these moldable materials, the first layer 202 and the second layer 204 are molded, which increases the ultimate densities of the layers 202 and 204. The apertures 210 are formed in the second layer 206, e.g., by a mold incorporating a progressive die set or a dedicated punch press to both mold the surface and punch the apertures therein or by rolling an intermediate panel (e.g., formed of the first layer 202, the honeycomb 204 and the second layer 206) across a perforating drum having piercing needles arranged at a desired pitch or spacing. The former technique is more suited to manufacturing on a small scale while the latter technique is more suited to manufacturing on a large scale.

The face of the panel 100 on the side of the first layer 202 exhibits a general sound-absorbing quality because of the molding media. The face of the panel 100 on the side of the second layer 206 exhibits a tuned sound-absorbing quality because of the Helmholtz resonators.

Figure 12:
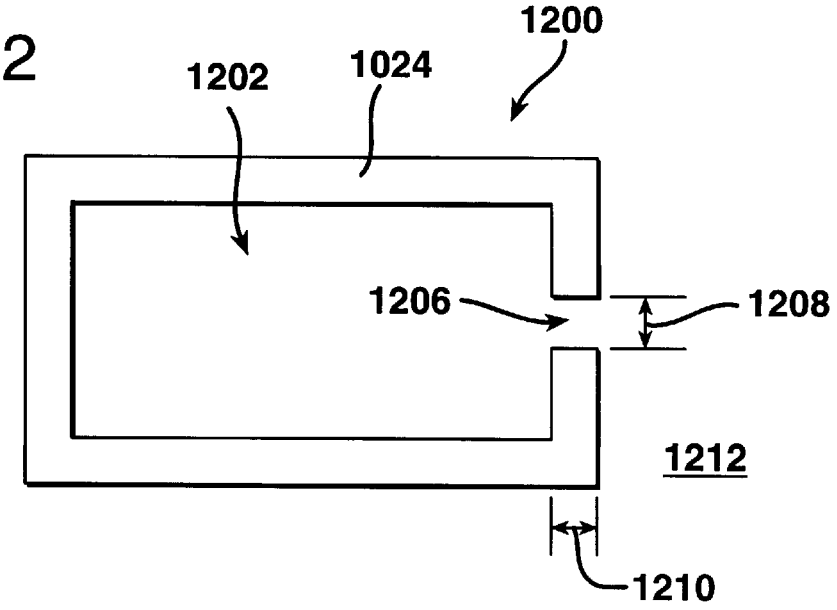
FIG. 12 is a cross-sectional view of a basic Helmholtz resonator.

The theory and physics of Helmholtz resonators are known. Thus, only a brief discussion of the theory and physics will be provided in regard to FIG. 12. A cross-sectional view of a basic Helmholtz resonator 1200 is illustrated in FIG. 12. The volume, V, of air in the chamber 1202 of the Helmholtz resonator 1200 is linked to the environment 1212 (containing a sound source) outside the resonator 1200 via an aperture 1206. The aperture 1206 has a cross-sectional area, S, and a length, L, indicated via items 1208 and 1210, respectively, in FIG. 12.

When sound impinges on the aperture 1206, the air in the neck of aperture will be induced to vibrate. In turn, this causes the volume of air in the cavity to undergo periodic compression and expansion. The friction between the air particles in the aperture 1206, and the resistance to air flow associated with the neck itself, cause the energy in sound waves to be absorbed. The efficiency of this absorption is at a maximum when resonance occurs, with the efficiency diminishing at frequencies above and below the resonant frequency.

The general equation governing the performance of a Helmholtz resonator is:

$$f_0 = \frac{C}{2\Pi}\sqrt{\frac{S}{LV}}$$

where $f_0$=resonant frequency (Hz)

C=velocity of sound (m/sec)

L=depth of hole (m)

S=cross-sectional area of hole ($m^2$)

V=volume of chamber ($m^3$)

D=diameter of hole (m) (assumed circular).

By appropriately selecting V, L and S, the resonant frequency of the Helmholtz resonator can be controlled.

A dual sonic character panel, such as those according to the invention, are advantageous because, e.g., they can act as either a tuned sound-absorbing panel or as a general sound-absorbing panel when suspended from a ceiling or when mounted to the ceiling and/or one or more walls, as will discussed below, respectively. In addition, achieving the dual sonic character only slightly complicates the manufacture of typical composite panes, such as those according to the Fearon patent. Moreover, the light weight of these panels affords a great many more circumstances for which they can be used than are available to the prior art panels, such as those of the Saylor patent.

Figure 3:
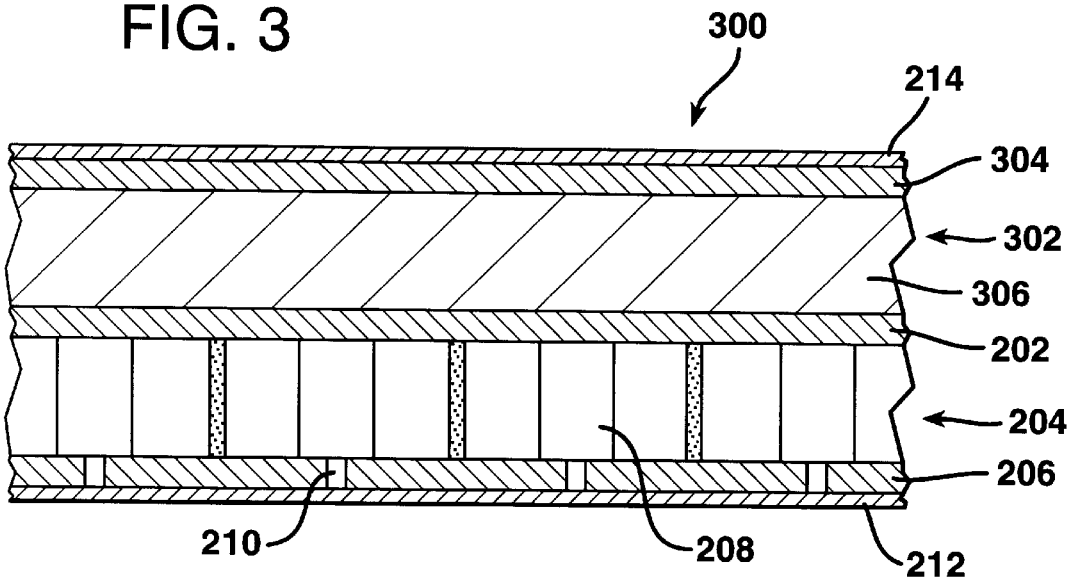
FIG. 3 is a cross-sectional view of a second embodiment, according to the invention, which emphasizes an acoustically significant panel.

FIG. 3 is a cross-sectional view of a second embodiment, according to the invention, which emphasizes an acoustically significant panel 300. The panel 300 is a sandwich or composite panel that is similar to the panel 100 of FIGS. 1–2, except for the following additional aspects. Between the first layer 202 of molding media and the second layer 214 of acoustically transparent decorative fabric, the panel 300 includes a general diffuser structure 302.

The general diffuser structure 302 includes: a fiber mat 304, e.g., approximately 50 g/$m^2$ glass fiber or polymer fiber; and preferably, but not necessarily, a backing structure 306, e.g., gypsum wall board, fiberglass board or mineral wool. The technology of such a diffuser structure, as well as other aspects of composite acoustically significant panel construction and manufacture, are disclosed in copending and commonly assigned U.S. patent application, Ser. No. 08/871,021, McGrath et al., entitled "Acoustical Room Paneling and Method of Installation," filed Jun. 6, 1997 (the copending McGrath application), which is hereby incorporated by reference in its entirety.

The face of the panel 300 on the side of the second layer 206, again, exhibits a tuned sound-absorbing quality because of the Helmholtz resonators. The face of the panel 300 on the side of the general diffuser structure 302 exhibits a general sound-diffusing quality because of the hardness of the fiber mat 304.

Figure 4:
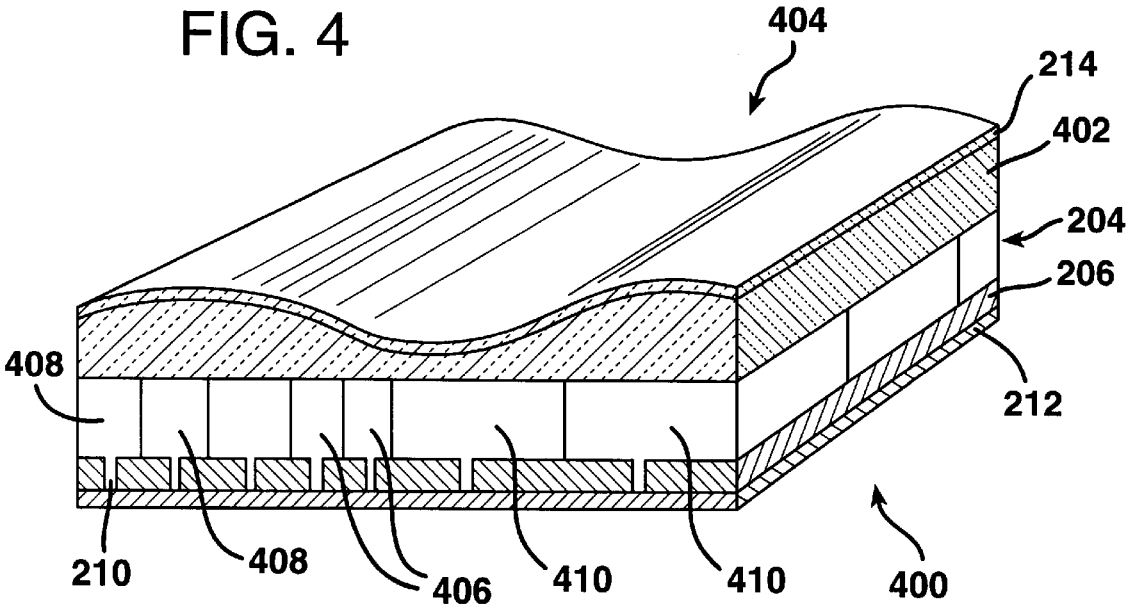
FIG. 4 is a cross-sectional view of a third embodiment, according to the invention, which emphasizes an acoustically significant panel.

FIG. 4 is a cross-sectional view of a third embodiment, according to the invention, which emphasizes an acoustically significant panel 400. The panel 400 is a sandwich or composite panel that is similar to the panel 100 of FIGS. 1–2, except for the following additional aspects. The chambers need not all be of the same size, as emphasized by the small, medium and large chambers 406, 408 and 410, respectively, which correspond to the chambers 208.

More importantly, as a way to enhance the general sound absorptivity of the panel 400, the first layer 402 of molding media (corresponding to layer 202) is molded to have a non-planar surface, e.g., such as the wavy surface 404. Again, the copending McGrath application is hereby incorporated by reference in its entirety for its disclosure of technology to mold a composite panel having a non-planar surface, such as surface 404 formed into a layer of molding media, as well as other technological aspects.

Figure 5:
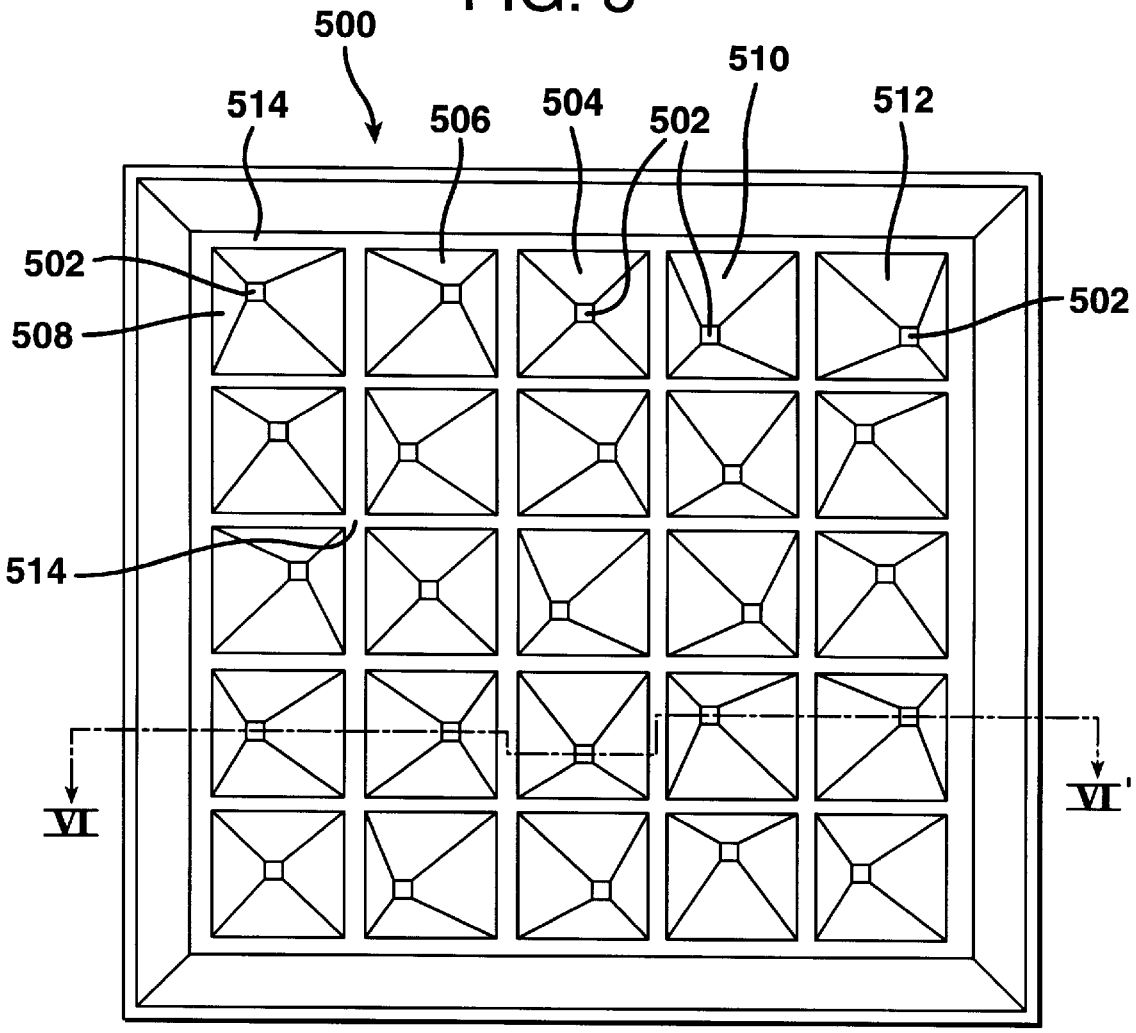
FIG. 5 is a top plan view of a fourth embodiment, according to the invention, which emphasizes an acoustically significant panel.
Figure 6:
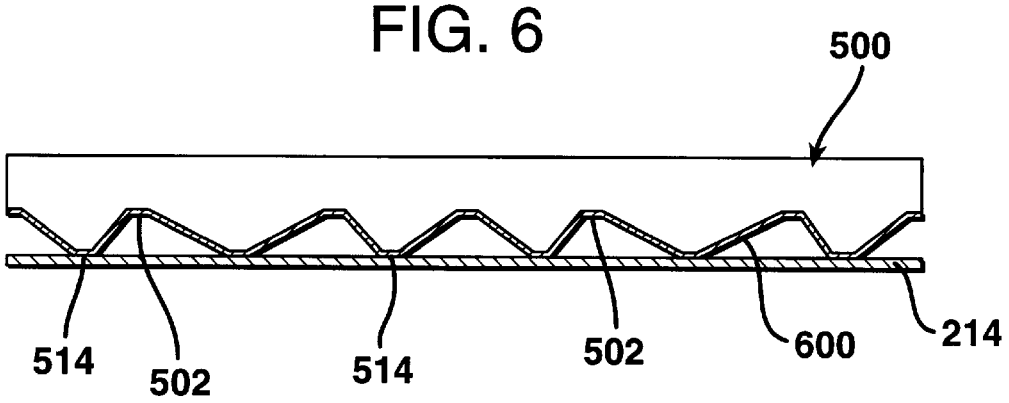
FIG. 6 is a partial cross-sectional view of the fourth embodiment.

FIG. 5 is a top plan view of a fourth embodiment, according to the invention, which emphasizes an acoustically significant panel 500. The panel 500 is a sandwich or composite panel that is similar to the panel 400 of FIG. 4, except for the following aspects. As an alternative to the wavy surface 404, FIG. 5 depicts a non-planar surface having truncated pyramidal depressions formed in a raised surface 514. The pyramid-based surface 600 is depicted in FIG. 6, which is a partial cross-sectional view the panel 500 of FIG. 5. The flat surfaces resulting from the truncation serve as locating points when the panel is reversed.

The non-uniformity of the non-planar, pyramid-based surface 600 is exaggerated by centering some of the apexes 502, as in the truncated pyramidal depressions 504, and by locating some of the apexes 502 off center, as in the truncated pyramidal depressions 506 (upper left relative to center), 508 (upper right relative to center), 510 (lower left relative to center) and 512(lower right relative to center), respectively.

Figure 7:
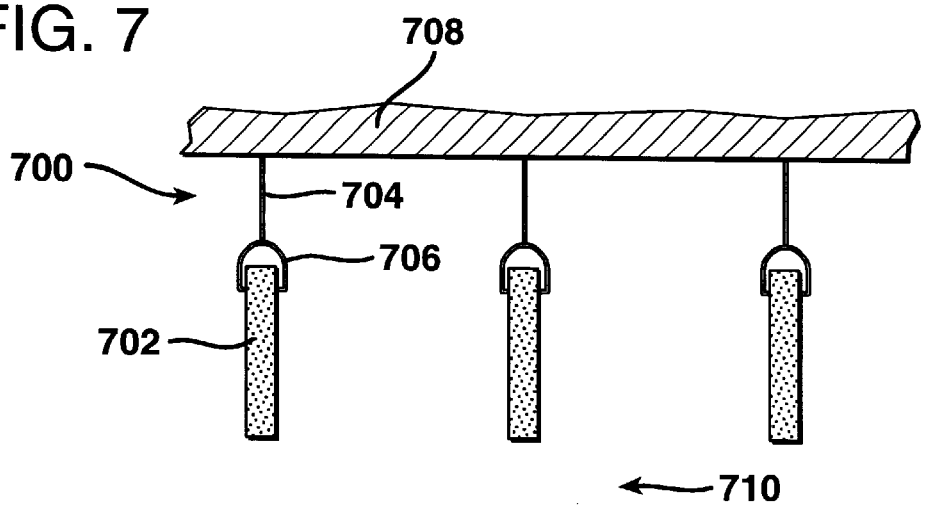
FIG. 7 is a side plan view of a fifth embodiment, according to the invention, which emphasizes a noise-dampening system.
Figure 8:
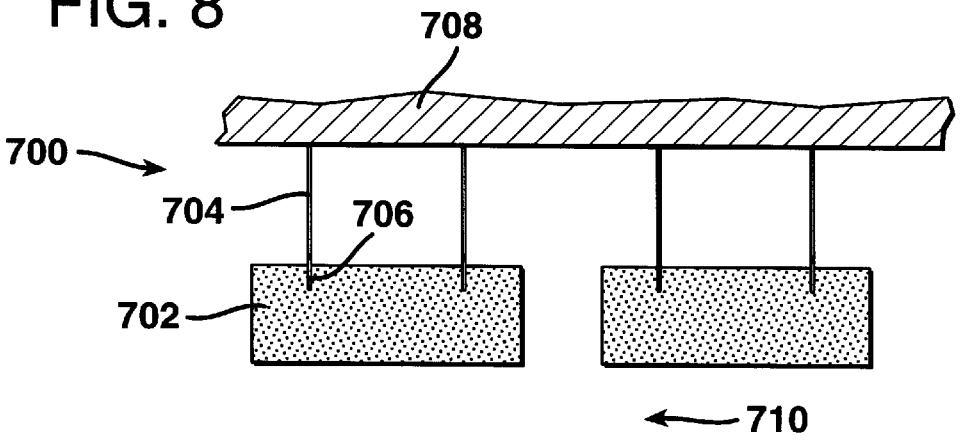
FIG. 8 is a front plan view of the fifth embodiment.

FIG. 7 is a side plan view of a fifth embodiment, according to the invention, which emphasizes a noise-dampening system 700. FIG. 8 is a front plan view of the dampening system 700 FIG. 9 is a partial three-quarter perspective view of the dampening system 700.

Figure 9:
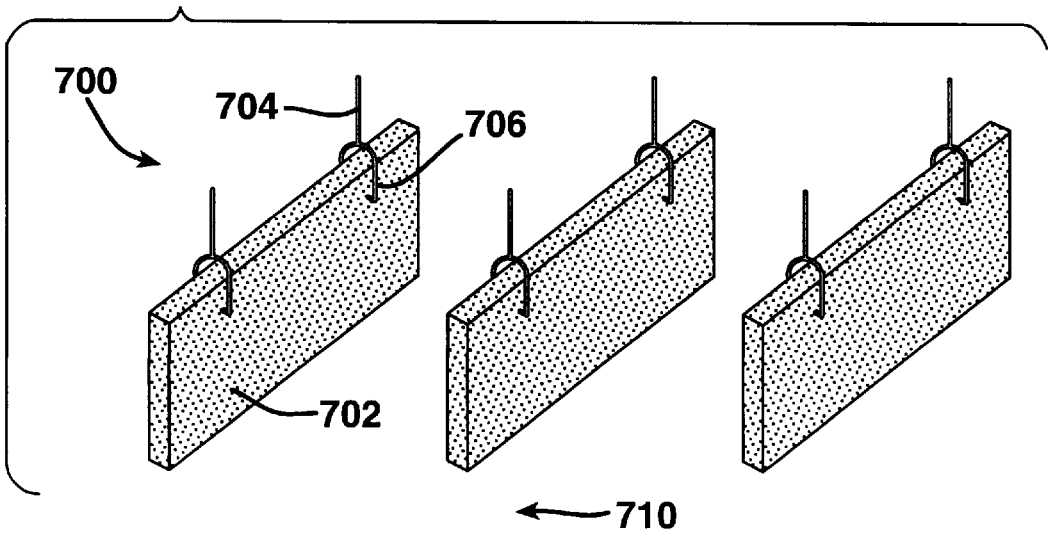
FIG. 9 is a partial three-quarter perspective view of the fifth embodiment.

The sound dampening system of FIGS. 7–9 includes a matrix of acoustically significant panels 702 suspended from roof/ceiling 708. Alternatively, though a matrix of two or more panels is preferred, one very large panel 708 could be used. Connectors 704 attached the panels 700 to the roof/ceiling 708 via bails or bridles 706. The connectors 704 can be rope, chain or cable. The panels are light in weight, so as not to impose a significant load on the roof/ceiling 708.

Figure 10:
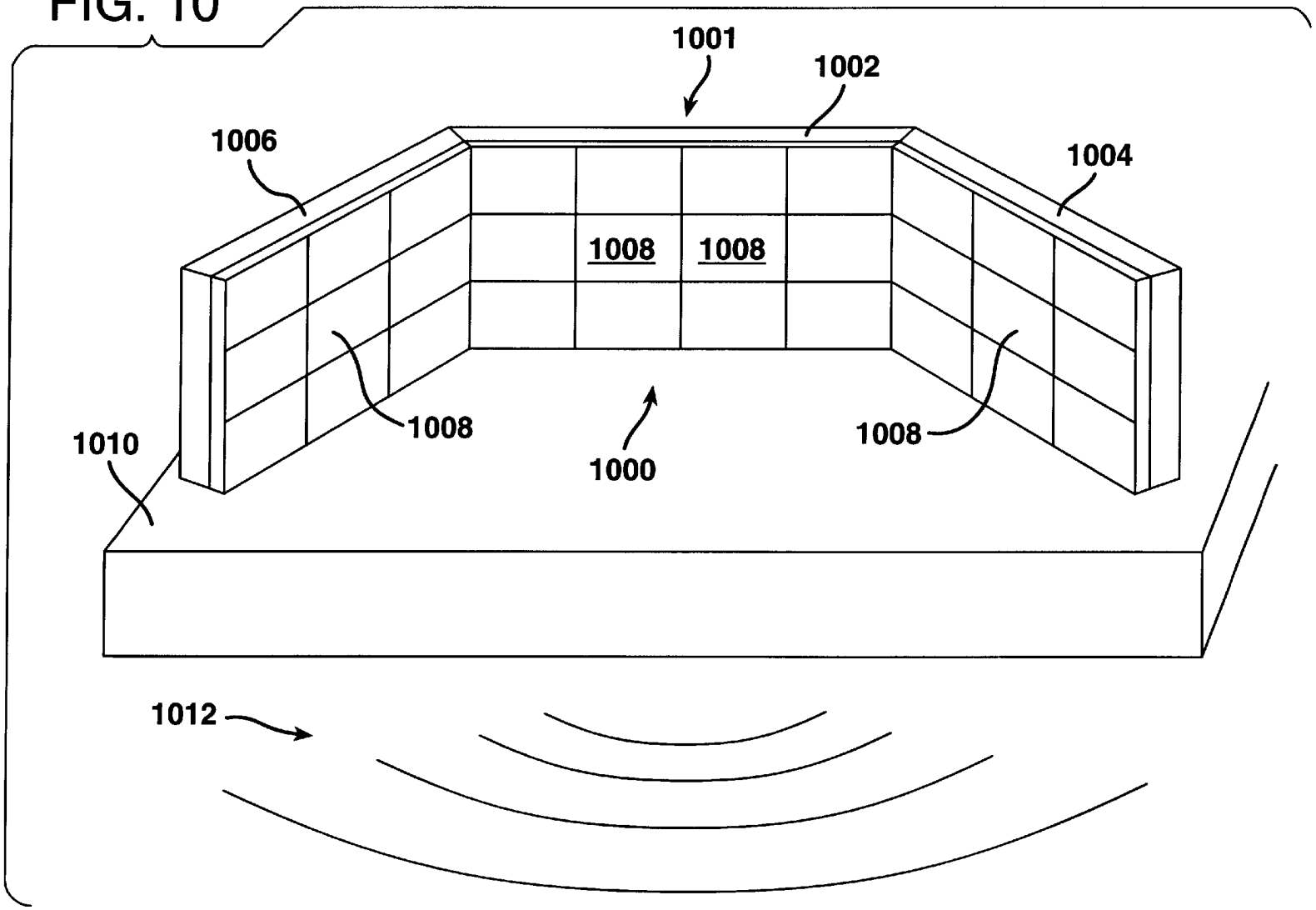
FIG. 10 is an front elevated perspective view of a sixth embodiment, according to the invention, which emphasizes a first application of a sound control system.

FIG. 10 corresponds to the circumstance in which it is desired to control noise in a region 710 (depicted in the context of FIGS. 7–9). The region 710 is defined by the roof/ceiling 708 (See FIGS. 7–8) over it. Such circumstances are typically (but not exclusively) found in a pavilion, an indoor sports arena having audience seating, an at least semi-enclosed stadium or gymnasium. Such circumstances usually have roofs/ceilings 708 that cover a large area. Unless specifically engineered to handle a very heavy static load (at a much greater construction cost) , a roof/ceiling 708 in these circumstances is steel decking that can only support a matrix of light weight panels, such as those according to the invention.

In the circumstance in which the roof/ceiling 708 is part of a gymnasium, sports arena with seating or a pavilion, uncontrolled low frequency sound reverberation, e.g., around a frequency of 500 Hertz (Hz), is a problem. Any one of the panels according to the first to fourth embodiments of the invention have a face whose maximum absorptivity can be tuned to 500 Hz. In this system, the first, third and fourth embodiments (e.g., FIGS. 1–2 and 4–6) are more preferred than the second embodiment (e.g., FIG. 3) because the first, third and fourth embodiments present a second face that is generally sound-absorbing rather than a second face that is generally sound-diffusing. In the sports circumstances, the panels can be decorated to look like banners.

FIG. 10 is a front elevated perspective view of a sixth embodiment, according to the invention, which emphasizes a first application of a sound control system 1001. FIG. 10 depicts a stage 1010, as might be found in a concert hall or an amphitheater, facing a seating area 1012. The system 1001 is used to control sound relative to a region 1000 defined by the walls 1002, 1004 and 1006.

The system 1001 includes at least one of the walls 1002, 1004 and 1006, the surfaces of which are covered by one or more acoustically significant panels 1008. Any one of the panels according to the first to fourth embodiments are suitable examples of the panels 1008. Many, if not most, of these panels will have a general sound-absorbing side turned toward the seating area 1012.

It is preferable, but not necessary, to use a combination of two or more of the panels according to the first to fourth embodiments. Such a combination would permit fine tuning of the sonic quality of the region 1000 on the stage 1010. Such fine tuning includes: eliminating acoustically dull spots by the strategic positioning of one or more of the panels 300 with the general sound-diffusing faces toward the seating area; and eliminating acoustically bright spots by strategic positioning of one or more of the panels 100, 400 and 500 with the tuned sound-absorbing faces toward the seating area.

Figure 11:
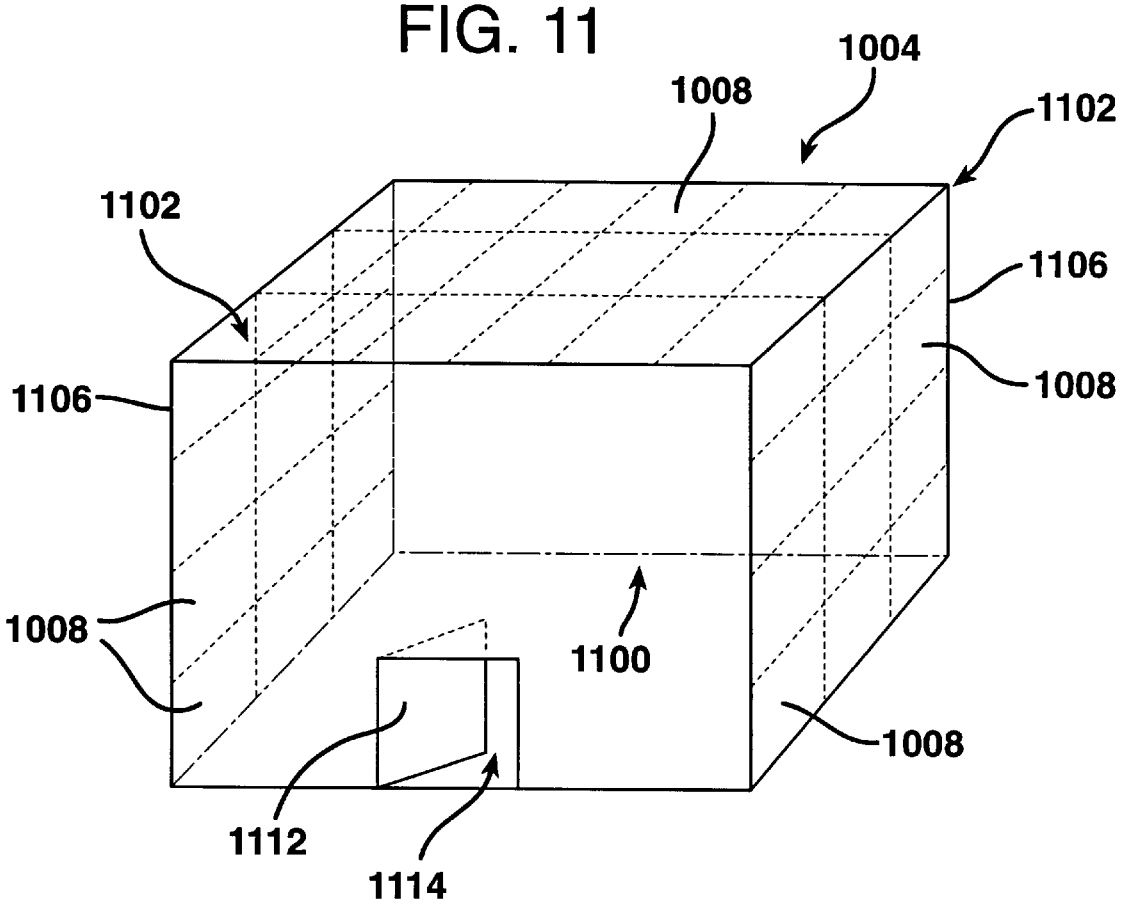
FIG. 11 is a front elevated, three-quarter perspective view of the sixth embodiment which emphasizes a second application of a sound control system.

FIG. 11 is a front elevated, three-quarter perspective view of the sixth embodiment which emphasizes a second application of a sound control system 1001. FIG. 11 emphasizes the circumstance in which the region 1100, for which sound control is desired, is inside a room having a ceiling 1104 and walls 1106, and includes at least one door 1112 and its associated opening 1114 in one of the walls 1106. Such a room might be used as a movie theater, an auditorium, a concert hall, a recording studio, a home theater or an office. Sound control is achieved in a manner similar to that described regarding FIG. 10.

In FIGS. 10 and 11, many techniques can be used to secure the panels 1008 to the walls. One such technique is to use screws or nails. Another, more preferred, technique is to use the clamp assembly disclosed in copending and commonly assigned U.S. patent application, Ser. No. 09/209,307, McGrath et al., entitled "Clamp Assembly for Attaching Panels to Substrate," filed Dec. 11, 1998.

The invention provides a dual sonic character composite or sandwich panel that is very light in weight. The tuned sound-absorbing face of the panels according to the invention, in combination with their light weight, greatly increases the range of circumstances in which paneled sound-control technology can be used.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An acoustically significant non-metallic composite panel having a general sound-absorbing face and a tuned sound-absorbing face comprising:

a honeycomb of cells;

a first structural layer of molding media attached to a first side of said honeycomb; and a second structural layer of molding media attached to a second side of said honeycomb opposite to said first side;

said first layer, said honeycomb and said second layer together defining a matrix of chambers; and said chambers having apertures, respectively, in said tuned sound-absorbing face to define said chambers as Helmholtz resonators by which said tuned sound-absorbing face is tuned;

said first layer defining a general absorber as a second face of said panel.

2. The panel of claim 1, further comprising:

a first layer and a second layer of non-reflective decorative material on said first layer and said second layer of molding material, respectively.

3. The panel of claim 1, wherein said cells in said honeycomb are hexagonal.

4. The panel of claim 1, wherein a side of said second layer of molding media opposite to said honeycomb of cells is non-planar.

5. The panel of claim 4, wherein said non-planar surface is wavy.

6. The panel of claim 4, wherein said non-planar surface includes a plurality of pyramidal surfaces.

7. The panel of claim 6, wherein all of said pyramidal surfaces are projections or depressions.

8. The panel of claim 6, wherein said plurality of pyramidal surfaces exhibits a plurality of apex locations.

9. The panel of claim 1, wherein said molding media is medium density moldable fiberglass, open-cell melamine foam or mineral wool board.

10. The panel of claim 1, wherein said first layer is planar.

11. The panel of claim 1, wherein said second layer has a plurality of apertures defining a plurality of Helmholtz resonators, respectively.

12. The panel of claim 11, wherein said plurality of Helmholtz resonators are all tuned to the same frequency.

13. The panel of claim 11, wherein each one of said plurality of Helmholtz resonators is tuned to one of three frequencies.

14. A noise-dampening system for a region defined by a ceiling thereover, said system comprising:

at least one sound absorbing non-metallic composite panel having a general sound-absorbing face and a tuned sound-absorbing face comprising:

a honeycomb of cells:

a first structural layer of molding media attached to a first side of said honeycomb; and a second structural layer of molding media attached to a second side of said honeycomb opposite to said first side;

said first layer, said honeycomb and said second layer together defining a matrix of chambers; and said chambers having apertures, respectively, in said tuned sound-absorbing face to define said chambers as Helmholtz resonators by which said sound-absorbing face is tuned;

said first layer defining said general sound-absorbing face; and at least one connector to suspend said panels from said ceiling, respectively;

said at least one panel being suspended vertically from said ceiling by said at least one connector.

15. The system of claim 14, wherein said at least one panel is suspended from said ceiling by two connectors.

16. The system of claim 14, wherein said at least one connector is flexible.

17. The system of claim 16, wherein said at least one connector is one rope, chain or cable.

18. The system of claim 14, wherein said system includes at least two of said panels.

19. The system of claim 14, wherein said ceiling is part of a room or pavilion.

20. A sound control system for a region defined by at least one wall, said system comprising:

a plurality of acoustically significant non-metallic composite panels attached to said at least one wall;

at least one of said panels having a general sound-absorbing face and a tuned sound-absorbing face, wherein said tuned sound-absorbing face includes a plurality of Helmholtz resonators by which the face is tuned.

21. The system of claim 20, wherein at least one of said panels has a tuned sound-absorbing face and a general sound-diffusing face.

22. The system of claim 21, wherein each one of said plurality of panels has a tuned sound-absorbing face and one of a general sound-absorbing face and a general sound-diffusing face.

23. The system of claim 20, wherein said at least one of said plurality of panels having said tuned sound-absorbing face and said general sound-absorbing face includes:

a honeycomb of cells;

a first structural layer of molding media attached to a first side of said honeycomb; and a second structural layer of molding media attached to a second side of said honeycomb opposite to said first side;

said first layer, said honeycomb and said second layer together defining a matrix of chambers; and said chambers having apertures, respectively, in said second face to define said chambers as Helmholtz resonators;

said second layer, having said at least one aperture therein, defining said tuned sound-absorbing face and said first layer defining said general sound-absorbing face.

24. The system of claim 22, wherein at least one of said plurality of panels has a tuned sound-absorbing face and a general sound-diffusing face, such a panel including:

a honeycomb of cells;

a first layer of molding media attached to a first side of said honeycomb; and a second layer of molding media attached to a second side of said honeycomb opposite to said first side;

a general diffuser structure attached to said second layer of molding media, said general diffuser structure having a fiber mat;

said first layer, said honeycomb and said second layer together defining a matrix of chambers; and said chambers having a plurality of apertures, respectively, in said second face to define said plurality of chambers as Helmholtz resonators;

said fiber mat defining said general sound-absorbing face.

25. The system of claim 24, wherein said general diffuser structure further includes a third layer of molding media between said fiber mat and said second layer of molding media.

26. The system of claim 20, wherein said at least one wall is part of a full room or stage.

* * * * *